US006585859B1

(12) United States Patent
Håkansson

(10) Patent No.: US 6,585,859 B1
(45) Date of Patent: Jul. 1, 2003

(54) METHOD FOR THE PRODUCTION OF SIZED PAPER OR SIZED CARDBOARD, AND SIZED PAPER OR SIZED CARDBOARD

(75) Inventor: Philip Håkansson, Sölvesborg (SE)

(73) Assignee: Stora Kopparbergs Bergslags Aktiebolag (publ), Falun (SE)

( * ) Notice: Subject to any disclaimer, the term of this patent is extended or adjusted under 35 U.S.C. 154(b) by 0 days.

(21) Appl. No.: 09/913,584

(22) PCT Filed: Jan. 19, 2000

(86) PCT No.: PCT/SE00/00095

§ 371 (c)(1),
(2), (4) Date: Aug. 16, 2001

(87) PCT Pub. No.: WO00/49226

PCT Pub. Date: Aug. 24, 2000

(30) Foreign Application Priority Data

Feb. 17, 1999 (SE) ..... 9900520

(51) Int. Cl.[7] ..... D21H 17/28; D21H 21/16

(52) U.S. Cl. ..... 162/175; 762/158; 762/164.1; 762/183

(58) Field of Search ..... 162/158, 175, 162/164.1, 164.3, 164.6, 183; 536/106

(56) References Cited

U.S. PATENT DOCUMENTS

| | | | | |
|---|---|---|---|---|
| 4,810,785 A | * | 3/1989 | Johnson | 127/32 |
| 4,964,915 A | * | 10/1990 | Blixt et al. | 106/214.2 |
| 5,116,924 A | | 5/1992 | Bung et al. | |
| 5,122,231 A | * | 6/1992 | Anderson | 162/175 |
| 5,169,886 A | * | 12/1992 | Bung et al. | 524/238 |
| 5,368,690 A | | 11/1994 | Solarek et al. | |
| 5,523,339 A | * | 6/1996 | Solarek et al. | 524/47 |
| 6,165,321 A | * | 12/2000 | Pauley et al. | 162/135 |
| 6,296,696 B1 | * | 10/2001 | Letourneau et al. | 106/150.3 |

FOREIGN PATENT DOCUMENTS

| | | |
|---|---|---|
| EP | 0 353 212 | 1/1990 |
| EP | 0 824 161 A2 | 2/1998 |
| WO | 96/23105 | 8/1996 |
| WO | 97/37079 | 10/1997 |

* cited by examiner

*Primary Examiner*—Jose A. Fortuna
(74) *Attorney, Agent, or Firm*—Nixon & Vanderhye

(57) ABSTRACT

Size composition in the form of a water-based composition containing a hydrophobic, cellulose-reactive sizing agent and an anionic, cationic and/or amphoteric polymer comprising a cross-linked starch. The hydrophobic, cellulose-reactive sizing agent comprises an alkylketene dimer.

26 Claims, No Drawings

METHOD FOR THE PRODUCTION OF SIZED PAPER OR SIZED CARDBOARD, AND SIZED PAPER OR SIZED CARDBOARD

TECHNICAL FIELD

The invention relates to a new composition, which is applicable as a so-called size composition in connection with the production of paper, paper board and similar products. The invention also relates to a method for manufacturing sized paper or sized paper board. Finally, the invention relates to sized paper or sized paper board, which paper or paper board comprises a size composition according to the invention.

More specifically, the invention relates to a composition in the form of a water-based emulsion or dispersion comprising at least some hydrophobic, cellulose-reactive sizing agent and a cross-linked, anionic, cationic and/or amphoteric starch.

BACKGROUND TO THE INVENTION

Water-based emulsions or dispersions of hydrophobic sizing agents are used to reduce the rate of liquid penetration into the structure of a paper or paper board. Examples of paper and paper board grades of this kind are photocopying paper, writing and printing paper, paper for so-called inkjet printers and paper board for juice, milk and other liquid packagings. These grades thus need for their application to have certain liquid-repellent properties. This effect can be achieved in various ways. The most common method is to add an emulsion or dispersion of a hydrophobic material and a cationic starch during the paper production process. Many different hydrophobic materials can be used. Among the most effective and most used are so-called hydrophobic, cellulose-reactive sizing agents. When using this type of agent, it is believed that the hydrophobic effect is obtained by means of a reaction between the hydrophobic material and the hydroxyl groups in the cellulose.

In neutral or weakly alkaline conditions during paper or paper board manufacture, hydrophobic, cellulose-reactive material of the alkylketene dimer (termed AKD below) or alkenyl succinic anhydride (termed ASA below) type is often used. The above-named hydrophobic materials are thus cellulose-reactive and bind directly to the carboxyl groups in the cellulose.

For the aforementioned hydrophobic material to be attracted, often termed retained, to the anionic cellulose fibre material, a polymer is added in the emulsifying or dispersion process. This polymer, which in most cases consists of starch, will give each particle of the sizing agent (e.g. AKD and/or ASA) a charge, so that it is attracted (retained) to the cellulose fibre. The starches occurring most commonly in size compositions are normally of a cationic character. However, anionic and amphoteric starch types also occur.

The starch also acts like a protective colloid, lying like a thin "shell" around each particle of the sizing agent and producing a stabilizing effect on the size composition's dispersion or emulsion. The aim is that particles of the sizing agent should be prevented from reacting with substances other than cellulose fibres. Above all, the sizing agent is to be prevented from hydrolysis due to reacting with water.

Emulsions and dispersions in which the hydrophobic material consists of ASA are produced according to a so-called in-situ process, i.e. in close proximity to the composition's application, i.e. in practice adjacent to the machine or machines which manufacture the paper or paper board. This is due to the fact that ASA has a tendency to hydrolysis, i.e. it reacts with the water present in the emulsion or dispersion. The finished composition cannot therefore be stored, especially not under unfavourable conditions such as high temperature, which is a problem particularly in hotter countries.

AKD emulsions or dispersions, however, are more stable and can be stored for a long time without losing the sizing effect. In spite of this fact, it can be advantageous to produce these emulsions or dispersions also according to the so-called in-situ process.

Emulsions or dispersions can also consist of a mixture of AKD and ASA. These emulsions or dispersions are also best manufactured according to the so-called in-situ process.

Known size compositions exhibit problems such as a slowly developed hydrophobicity, poor adhesion of toner and deposition of hydrolysis products when photocopying and reduced effectiveness during paper manufacture due to interruptions as a result of poor hydrophobicity and the occurrence of hydrolysis products. Another problem is poor resistance to hydrogen peroxide in connection with the filling of liquids in packagings of liquid paper board. When using highly substituted starches, i.e. starches with high cation activity, problems of stability can also occur for the emulsion/size composition. With high dry contents in particular, i.e. dry contents of more than 20%, of the size composition, problems often occur with its stability. This is also temperature-dependent, it most often being necessary in hot countries to have dry contents which are even lower, in order to achieve stability.

Patent literature describes the use of cross-linked starch in connection with paper manufacture, the cross-linked starch not however being used in size compositions. Such patents include e.g. U.S. Pat. No. 4,810,785, U.S. Pat. No. 5,122,231, U.S. Pat. No. 5,368,690, U.S. Pat. No. 5,523,339.

DESCRIPTION OF THE INVENTION

The object of the invention is to provide a size composition by means of which the aforementioned problems are eliminated or restricted. This can be achieved in that the starch used on production of the size composition principally comprises anionic, cationic and/or amphoteric starch, which is cross-linked.

The cross-linked starch which is used in this invention can include starch which is treated with one or more of the compounds described in "Starch Derivates; Production and Uses" by M. Rutenberg and D. Solarek and "Starch; Chemistry and Technology", Chapter X, pp. 324–332, 1984 or in the patents referred to above. Cross-linking compounds of this kind are selected preferably from the group which consists of methylamine compounds, polyvalent (multivalent) acids, polyvalent acid esters, polyvalent acid halogenides, polyvalent acid anhydrides, polyaldehydes, polyepoxides, polyisocyanates, divinyl compounds, phosphoryl chloride, polyamine polyepoxide resin, 1,4 butanediol diglycidylether, epichlorohydrin, trimethaphosphates, a mixture of anhydrides of acetic acid and two- or three-proton acids, sodium hypochlorite. However, other types of cross-linking compounds can also be used.

The starch, which is cross-linked and used in the size composition according to the invention, is selected preferably from the group which consists of potato starch, maize starch, wheat starch, waxy maize starch and tapioca. Other types of starch can also be used, however, or a mixture of different starches. Starch from potatoes which has been genetically modified in order to suppress formation of starch of the amylose type, in favour of starch of the amylopectin type, can also be used in the invention, see SE-A0-9704857-3. The weight ratio between starch and hydrophobic sizing agent (e.g. AKD and/or ASA) in the size composition is suitably 1:1 to 3:1, preferably 1.5:1 to 2.5:1, and most preferredly around 2:1.

The starch is substituted by chemical modification with cationic and/or anionic groups. When producing cationic starches, ammonium compounds are used in most cases which are preferably quaternary, but can also be primary or tertiary. A starch cationizing process of this kind is well known and described inter alia in U.S. Pat. No. 4,088,600, U.S. Pat. Nos. 2,876,217 and 4,840,705. In the production of anionic starches, the starch is substituted with anionic groups, which in most cases consist of carboxyl, carboxylate, sulphone, sulphonate, phosphonate or phosphate groups. This procedure is well described in literature, inter alia in the abovementioned publications of Morton W. Rutenberg and D. Solarek or STARCH: Chemistry and Technology by Roy L. Whistler, James N. Bemiller and Eugene F. Paschall. When manufacturing amphoteric starches, the starch is substituted with both cationic and anionic groups. This is also well known in literature.

The chemical composition of the stock system used in the manufacture of paper or paper board is definitive for the degree of substitution of the starch required for the optimum result. In this regard it is normally the quantity of impurities in the system which determines the degree of substitution which should be selected. For example, a stock system which is based on mechanical pulp, and which contains relatively large quantities of impurities, calls for a starch with a higher degree of substitution compared with a stock system which is based on chemical pulp. A poorly washed-out pulp and/or pulp with mixing-in of waste based on coated paper often also causes problems with large quantities of impurities. The composition of the stock and the nature of the impurities furthermore not only determine the degree of substitution which the starch should have in most cases, but also whether it should be cationic, anionic or amphoteric. The degree of substitution for the starch is between 0.01 and 0.3, preferably between 0.02 and 0.2 according to the invention.

It has surprising been found that effects are obtained by means of the abovementioned composition which considerably reduce or eliminate many of the shortcomings which can be associated with the prior art. Amongst other things, the stability of the size composition, progress of the hydrophobicity and effectiveness during paper production are improved. More specifically, the particles of sizing agent retain their charge better. The sizing agent (e.g. AKD and/or ASA) is prevented from being exposed to hydrolysis and other chemical attack. The time period which it is possible to store the size composition is extended and/or the opportunity to increase its dry content is obtained, which offers economic advantages. In photocopying, the adhesion of toner is improved and the deposition of hydrolysis products reduced. The resistance to hydrogen peroxide in connection with the filling of liquids into packagings of liquid paper board is also improved. The invention also results in that raw starch materials which are cheaper than waxy maize can be used, e.g. potato, maize, wheat or tapioca starch, better sizing properties nevertheless being obtained compared with waxy maize.

One theory is that the positive, surprising effects of the invention are due to the fact that a cross-linked starch is strongly branched and that it thereby provides even better attributes than a conventional starch. Consequently it appears as a more stable protective colloid due to the fact that it is constructed as "a network" and can therefore e.g. better resist the shear stresses to which the particles of sizing agent are exposed on pumping, screening and metering of the size composition and also the shear stresses to which the particles of sizing agent are exposed in the stock.

One main aim of the invention is thus to provide a new and improved size composition, which can be used for sizing paper, paper board and similar products.

Another object of the invention is to provide a new size composition, which is more effective than previously known compositions, due to which reduced quantities of sizing agent are required to obtain a hydrophobation degree similar to or corresponding to that for previously known compositions. Alternatively, when using the same quantities of sizing agent as in the prior art, better sizing can be obtained, such as measured according to the Cobb method, the Edge Wick test or the HST method. In particular, positive effects are obtained in difficult sizing conditions, such as e.g. when large quantities of impurities occur and/or strong shear stresses at high paper/paper board machine speeds.

Yet another object of the invention is to provide a new size composition, the sizing effect or sizing ability of which is developed more rapidly than for previously known compositions.

Another object is to provide a new size composition for which negative effects on the hydrophobation effect are considerably reduced or eliminated in connection with the use of precipitated calcium carbonate.

Yet another object is to provide a new size composition in which the amount of undesirable hydrolysis products are obtained in the paper or paper board manufacturing process is considerably reduced or eliminated, in comparison with the quantity of hydrolysis products which occurs when using conventional size compositions.

Another object of the invention is to provide a new size composition which is more stable than size compositions known hitherto.

A further object of the invention is to provide an improved method for producing sized paper or paper board using the new composition according to the invention.

Another object of the invention is to provide sized paper or sized paper board with improved properties.

According to the invention, these and other objects are achieved by providing a size composition in the form of a water-based dispersion or emulsion, the starch which is used in the production of the emulsion or dispersion consisting of anionic, cationic or amphoteric starch which has been cross-linked. The hydrophobic constituent of the emulsion or dispersion consists of AKD or ASA or a mixture of these two cellulose-reactive compounds.

Where the size composition according to the invention is concerned, it is naturally also understood that it can comprise further constituents if so desired or found suitable, it being possible for such further constituents to be selected in accordance with known principles. However, even though such constituents do not need to be specially described here to facilitate the execution of the invention, dispersants, aluminium compounds such as alum (aluminium sulphate) and polyaluminium chloride can be named for example among common additives.

EXAMPLE 1

Three different AKD dispersions were produced in the following way: 50 parts of a wax consisting of alkylketene dimer (AKD) were melted. This melt was added while stirring continuously to a hot solution consisting of 2 parts dispersant, 2500 parts water and 100 parts cationic starch, which in the 3 different dispersions consisted of:

1a/waxy maize starch

1b/potato starch of the type used earlier in size compositions

1c/cross-linked waxy maize starch

In all three cases, the starch was substituted with cationic groups to a substitution level of 0.035%. Quaternary ammonium groups were used for this purpose. Sheets of paper were produced in the laboratory from a standard stock according to the standard method SCAN-C23X. Dispersions produced according to 1a, 1b and 1c were used in three different series.

On the sheets of paper produced using dispersion 1c, i.e. using a size composition according to the invention, considerably better sizing was measured, measured according to the so-called Cobb method, than on the sheets of paper which were sized with dispersions produced according to 1a and 1b.

EXAMPLE 2

150 g/m$^2$ paper was produced in three different series from a stock consisting of 100% CTMP pulp. Dispersions produced according to 1a, 1b and 1c respectively were used in these three series.

The different sheets of paper were examined using the so-called edge penetration method (Edge Wick test) for 35% hydrogen peroxide solution.

The papers produced using the dispersion according to 1c exhibited, in a class of its own, the lowest edge penetration.

EXAMPLE 3

In a so-called in-situ process (directly adjacent to a paper or paper board machine), three different ASA (alkenyl succinic anhydride) emulsions were produced through the addition of 2 parts starch to 1 part ASA to the emulsion equipment. In the three cases, the following starch types were used:

3a/cationic maize starch with a degree of substitution of 0.05%

3b/cationic potato starch of the traditional type with a degree of substitution of 0.05%

3c/cationic cross-linked potato starch with a degree of substitution of 0.05%

The sizing on the paper produced using the emulsion in which starch according to 3c was used was markedly better than on paper produced with emulsions in which starch according to 3a and 3b was used.

EXAMPLE 4

In another so-called in-situ process, different emulsions or dispersions were produced by adding a mixture of ASA and AKD to the emulsion/dispersion equipment. Three different types of starch, described in example 3, were also added to the equipment. The ratio of starch to ASA was 2 to 1. The ratio of ASA/AKD varied from 5/100 to 100/5. The paper produced using emulsions including starch according to 3c exhibited the best sizing measured according to the Cobb method.

What is claimed is:

1. Method for producing sized paper or sized paper board, comprising adding a size composition during production of said paper or paper board wherein said size composition is in the form of a water-based composition comprising a hydrophobic, cellulose-reactive sizing agent and an anionic, cationic and/or amphoteric polymer comprising a cross-linked starch, said hydrophobic, cellulose-reactive sizing agent comprising an alkylketene dimer.

2. Method according to claim 1, wherein said size is added to a stock which is then dewatered.

3. Method according to claim 1, wherein said starch is selected from the group consisting of potato starch, maize starch, wheat starch, waxy maize starch, tapioca, and mixtures thereof.

4. Method according to claim 1, wherein said hydrophobic sizing agent is a mixture of alkylketene dimer and alkenyl succinic anhydride.

5. Method according to claim 1, wherein said starch has been cross-linked by means of one or more compounds selected from the group consisting of methylamine compounds, polyvalent (multivalent) acid, polyvalent acid esters, polyvalent acid halogenides, polyvalent acid anhydrides, polyaldehydes, polyepoxides, polyisocyanates, divinyl compounds, phosphoryl chloride, polyamine polyepoxide resin, 1,4-butanediol diglycidylether, epichlorohydrin, trimethaphosphates, a mixture of anhydrides of acetic acid and two- or three-proton acids, sodium hypochlorite, and mixtures thereof.

6. Method according to claim 1, wherein the cross-linked starch has been derived by a chemical, physical and/or enzymatic process.

7. Method according to claim 1, wherein the starch has been substituted with cationic groups by chemical modification with an ammonium compound, whereby it has acquired a cationic charge.

8. Method according to claim 7, wherein the starch has been substituted with cationic groups by chemical modification with a quaternary ammonium compound, whereby it has acquired a cationic charge.

9. Method according to claim 1, wherein the starch has been substituted with anionic groups by chemical modification, whereby it has acquired an anionic charge.

10. Method according to claim 9, wherein the starch has been substituted with anionic groups by chemical modification with carboxyl, carboxylate, carboxy-methyl, sulphone, sulphonate, phosphate or phosphonate groups, whereby it has acquired an anionic charge.

11. Method according to claim 1, wherein the starch has been substituted with both cationic and anionic groups, whereby it has become amphoteric.

12. Method according to claim 1, wherein the starch has a degree of substitution of 0.01–0.30.

13. Method according to claim 12, wherein the starch has a degree of substitution of 0.02–0.20.

14. Sized paper or sized paper board, comprising a size composition in the form of a water-based composition comprising a hydrophobic, cellulose-reactive sizing agent and an anionic, cationic and/or amphoteric polymer comprising a cross-linked starch, said hydrophobic, cellulose-reactive sizing agent comprising an alkylketene dimer.

15. Sized paper or sized paper board according to claim 14, wherein said size is added to a stock which is then dewatered.

16. Sized paper or sized paper board according to claim 14, wherein said starch is selected from the group consisting of potato starch, maize starch, wheat starch, waxy maize starch, tapioca, and mixtures thereof.

17. Sized paper or sized paper board according to claim 14, wherein said hydrophobic sizing agent is a mixture of alkylketene dimer and alkenyl succinic anhydride.

18. Sized paper or sized paper board according to claim 14, wherein said starch has been cross-linked by means of one or more compounds selected from the group consisting of methylamine compounds, polyvalent (multivalent) acids, polyvalent acid esters, polyvalent acid halogenides, polyvalent acid anhydrides, polyaldehydes, polyepoxides, polyisocyanates, divinyl compounds, phosphoryl chloride, polyamine polyepoxide resin, 1,4-butanediol diglycidylether, epichlorohydrin, trimethaphosphates, a mixture of anhydrides of acetic acid and two- or three-proton acids, sodium hypochlorite, and mixtures thereof.

19. Sized paper or sized paper board according to claim 14, wherein the cross-linked starch has been derived by a chemical, physical and/or enzymatic process.

20. Sized paper or sized paper board according to claim 14, wherein the starch has been substituted with cationic groups by chemical modification with an ammonium compound, whereby it has acquired a cationic charge.

21. Sized paper or sized paper board according to claim 20, wherein the starch has been substituted with cationic groups by chemical modification with a quaternary ammonium compound, whereby it has acquired a cationic charge.

22. Sized paper or sized paper board according to claim 14, wherein the starch has been substituted with anionic groups by chemical modification, whereby it has acquired an anionic charge.

23. Sized paper or sized paper board according to claim 22, wherein the starch has been substituted with anionic groups by chemical modification with carboxyl, carboxylate, carboxy-methyl, sulphone, sulphonate, phosphate or phosphonate groups, whereby it has acquired an anionic charge.

24. Sized paper or sized paper board according to claim 14, wherein the starch has been substituted with both cationic and anionic groups, whereby it has become amphoteric.

25. Sized paper or sized paper board according to claim 14, wherein the starch has a degree of substitution of 0.01–0.30.

26. Sized paper or sized paper board according to claim 25, wherein the starch has a degree of substitution of 0.02–0.20.

* * * * *